US010681957B2

(12) United States Patent
Duarte

(10) Patent No.: US 10,681,957 B2
(45) Date of Patent: Jun. 16, 2020

(54) SUSPENSION BRIDGING SHOE

(71) Applicant: Daniel Thomas Duarte, Torrance, CA (US)

(72) Inventor: Daniel Thomas Duarte, Torrance, CA (US)

( * ) Notice: Subject to any disclaimer, the term of this patent is extended or adjusted under 35 U.S.C. 154(b) by 138 days.

(21) Appl. No.: 14/857,622

(22) Filed: Sep. 17, 2015

(65) Prior Publication Data

US 2017/0079372 A1 Mar. 23, 2017

(51) Int. Cl.

*A43B 7/14* (2006.01)
*A43B 7/22* (2006.01)
*A43C 1/00* (2006.01)

(52) U.S. Cl.

CPC ..... *A43B 7/1495* (2013.01); *A43B 7/223* (2013.01); *A43B 7/226* (2013.01); *A43C 1/00* (2013.01)

(58) Field of Classification Search

CPC ..... A43B 7/18; A43B 7/22; A43B 7/1445; A43B 7/142; A43B 5/06; A43B 7/1495; A43C 1/04; A43C 11/004; A43C 1/003; A61F 13/06; A61F 13/064; A61F 13/065; A61F 13/066; A61F 13/067

USPC ..... 602/66; D24/192, 190

See application file for complete search history.

(56) References Cited

U.S. PATENT DOCUMENTS 1,286,787 A * 12/1918 Rokahr ..... A43B 5/06 36/114
1,627,596 A * 5/1927 Cutshaw ..... A61F 13/065 602/66
2,147,197 A * 2/1939 Glidden ..... A43B 1/02 36/3 A
2,741,039 A * 4/1956 Mathews ..... A43B 3/02 36/58.5
2,985,970 A * 5/1961 McCarthy ..... A43B 13/00 12/142 R
3,323,232 A * 6/1967 Danowsky ..... A43B 7/1495 36/76 R
4,439,936 A 4/1984 Clarke et al.
(Continued)

FOREIGN PATENT DOCUMENTS

| | | |
|---|---|---|
| EP | 2305057 | 4/2011 |
| EP | 2454959 | 5/2012 |
| FR | 2605194 | 4/1988 |

OTHER PUBLICATIONS

"Adidas Equipment Support 93 Shoes," retrieved online Sep. 5, 2015.

*Primary Examiner* — Katharine Gracz
(74) *Attorney, Agent, or Firm* — Cionca IP Law P.C.; Marin Cionca

(57) ABSTRACT

A shoe that simulates barefoot running having an outer sole having a forefoot portion, a heel portion, and a flexible bridge portion, wherein the flexible bridge portion is curved inwards to be narrower than a foot on both the lateral and medial sides, wherein the flexible bridge conforms to the foot's arch and is lifted off the ground when the shoe is tied onto the foot; a wrap overlay associated with the flexible bridge and having at least a first strap and at least a second strap, which are tied atop a metatarsal area of the foot, such that to suspend the flexible bridge therefrom and provide a 360 degrees wrap of the foot in the arch section of the foot, resulting in both, arch support and the shoe's anchoring to the foot; and, a roomy toe box providing toe splay and facilitating forefoot-striking

13 Claims, 7 Drawing Sheets

(56) References Cited

U.S. PATENT DOCUMENTS 4,510,699 A * 4/1985 Nakamura ..... A61F 5/14 36/173
4,550,511 A * 11/1985 Gamm ..... A43B 7/1495 36/117.9
4,926,569 A 5/1990 Bunch
5,377,430 A * 1/1995 Hatfield ..... A43B 3/08 24/714.6
5,692,319 A * 12/1997 Parker ..... A43B 7/1495 36/114
5,692,320 A * 12/1997 Nichols ..... A43C 1/04 36/170
5,940,990 A * 8/1999 Barret ..... A43B 5/00 36/50.1
6,052,921 A * 4/2000 Oreck ..... A43C 1/00 36/50.1
6,298,582 B1 * 10/2001 Friton ..... A43B 5/06 36/102
6,640,465 B1 * 11/2003 Burgess ..... A43B 7/141 36/15
8,074,379 B2 12/2011 Robinson, Jr. et al.
8,215,132 B2 * 7/2012 Dua ..... A43B 1/04 12/146 C
8,479,415 B2 * 7/2013 Berger ..... A43B 3/24 36/100
8,578,632 B2 * 11/2013 Bell ..... A43B 1/0072 36/45
8,650,916 B2 * 2/2014 Dua ..... A43B 1/04 36/45
8,857,077 B2 10/2014 Kahatsu et al.
8,869,435 B2 * 10/2014 Hatfield ..... A43B 5/001 36/102
9,743,709 B2 * 8/2017 Hesterberg ..... A43B 7/14
2003/0066207 A1 * 4/2003 Gaither ..... A43C 1/04 36/50.1
2003/0093924 A1 * 5/2003 Delgorgue ..... A43B 1/0072 36/117.3
2004/0181972 A1 * 9/2004 Csorba ..... A43B 7/1495 36/50.1
2005/0081403 A1 * 4/2005 Mathieu ..... A43C 1/00 36/50.1
2006/0117606 A1 * 6/2006 Chen ..... A43B 7/223 36/50.1
2006/0207123 A1 * 9/2006 Milner ..... A43B 1/0045 36/44
2007/0011914 A1 * 1/2007 Keen ..... A43B 1/14 36/50.1
2007/0186447 A1 8/2007 Ramos et al.
2008/0010854 A1 1/2008 Sokolowski
2008/0110048 A1 * 5/2008 Dua ..... A43B 1/04 36/45
2008/0289222 A1 * 11/2008 Candrian ..... A43B 1/0027 36/101
2009/0090027 A1 * 4/2009 Baudouin ..... A43B 7/1495 36/93
2009/0100715 A1 4/2009 Broadley
2009/0199435 A1 8/2009 Robinson, Jr. et al.
2009/0293310 A1 12/2009 Bruce et al.
2011/0113648 A1 * 5/2011 Leick ..... A43B 1/0081 36/50.1
2011/0239486 A1 * 10/2011 Berger ..... A43B 3/24 36/136
2012/0011744 A1 * 1/2012 Bell ..... A43B 1/0072 36/91
2012/0285043 A1 * 11/2012 Dua ..... A43B 1/04 36/84
2013/0104423 A1 * 5/2013 Hatfield ..... A43B 5/001 36/103
2014/0075782 A1 * 3/2014 Bell ..... A43B 1/0072 36/92
2014/0150295 A1 * 6/2014 Dua ..... A43B 1/04 36/84

* cited by examiner

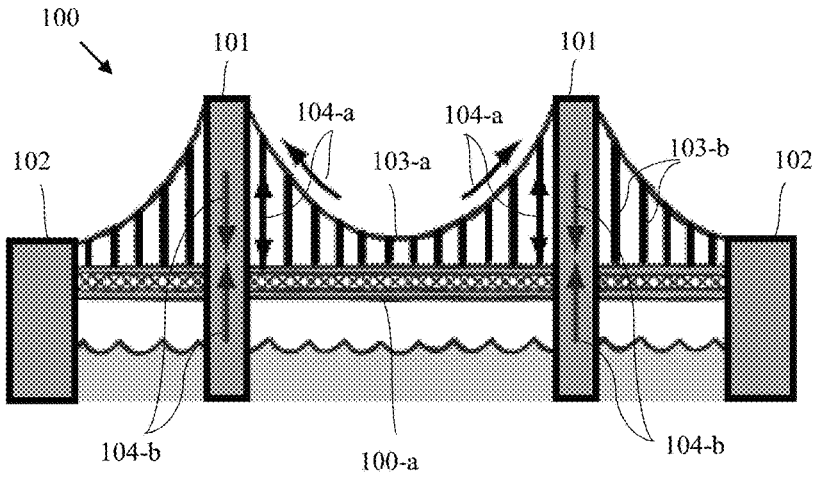
FIG. 1 – Prior Art
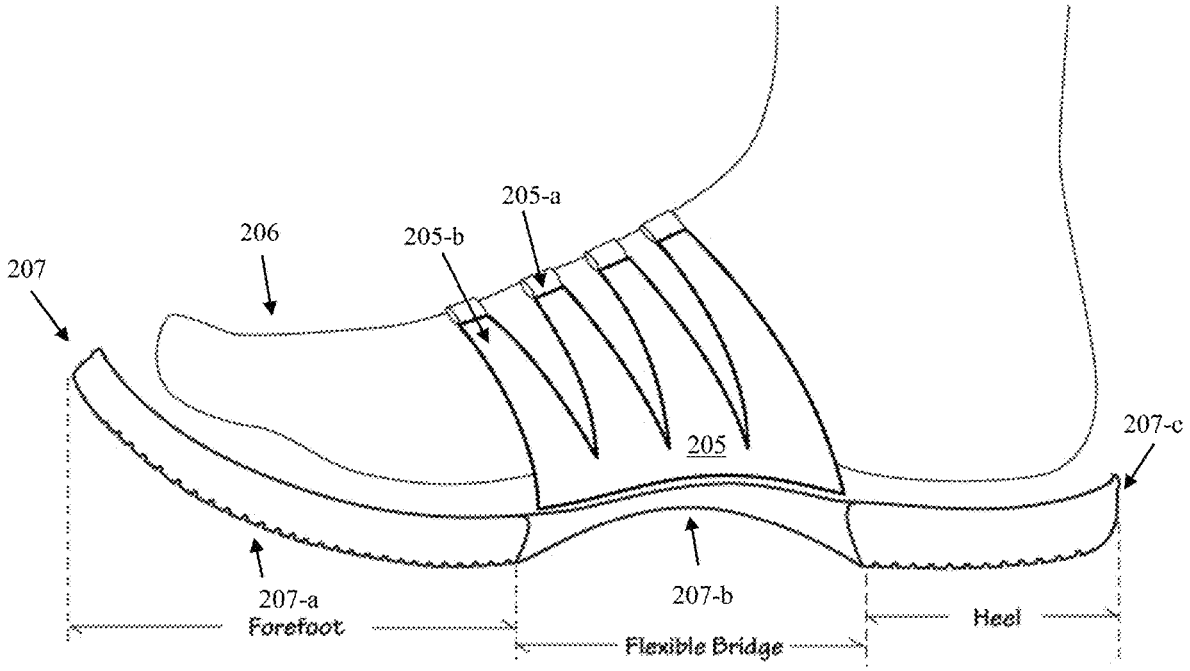
FIG. 2a

SUSPENSION BRIDGING SHOE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The invention relates generally to footwear, and more particularly to athletic footwear for running.

2. Description of the Related Art

Barefoot running, or natural running, is favored by many runners and joggers, who find that it is conducive to the proper, most injury-free way to run: to land on the forefoot. Wearing traditional running shoes often causes the runner to land on their heels, which impacts the skeletal system and can lead to joint injuries. In contrast, a forefoot-striking gait engages the muscular system to shock absorb the runner's landings, reducing the risk of injury. Another benefit of barefoot running is having a free feel and "toe splay." However, the foot protection and arch support that a shoe provides are still desired. Arch support aids the runner and is comfortable for the foot, but arch support of traditional running shoes is normally in set dimensions and humans have a variety of needs with regards to those dimensions.

Therefore, there is a need for an adjustable arch support and a lacing system that allows for the variable dimensional needs of the consumer and allows for an unencumbered toe box which facilitates free feel, "toe splay" and forefoot-striking running resembling barefoot running.

The problems and the associated solutions presented in this section could be or could have been pursued, but they are not necessarily approaches that have been previously conceived or pursued. Therefore, unless otherwise indicated, it should not be assumed that any of the approaches presented in this section qualify as prior art merely by virtue of their presence in this section of the application.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one exemplary embodiment, a moveable shoe wrap overlay wrapping around the arches of the foot is provided. A shoe "bridge," part of the sole, is supported from above by the overlay, and is be flexible to conform to the foot. The bridge is narrower than the foot, exposing the foot on both sides, such that the wrap overlay can provide a "full wrap effect" and 360 degrees of support around the foot. Laces are used with the overlay and are excluded from places other than the arches of the foot on the shoe. The toes are unwrapped, creating a roomy toe box and allowing for toe splay, an important component of barefoot running. Thus, an advantage is that there are several simultaneous benefits during running: toe splay, free feel and forefoot-striking, which mimic barefoot running, and arch support.

In another exemplary embodiment, the laces are used to thread into a collar anchor of the shoe upper, which wraps around the ankle, and a loop anchor at the top of the toe box, near the arches of the foot. An advantage is that the anchoring points may help to securely anchor the shoe to the foot.

In another exemplary embodiment, the lateral forefoot side of the shoe may have a rounded edge. Thus, an advantage is more support for runners who land on the lateral edges of their feet. It should be understood that the medial side or heels may also similarly be rounded.

In another exemplary embodiment, the overlay is associated with the outer sole and wraps around the foot from inside of the outer sole.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which:

FIG. 1 illustrates the side view of a suspension bridge, as in the prior art.

FIG. 2*a* illustrates a side view of an overlay and an outer sole of a suspension bridging shoe, according to an embodiment.

DETAILED DESCRIPTION OF THE PREFERRED EMBODIMENTS

Figure 2B:
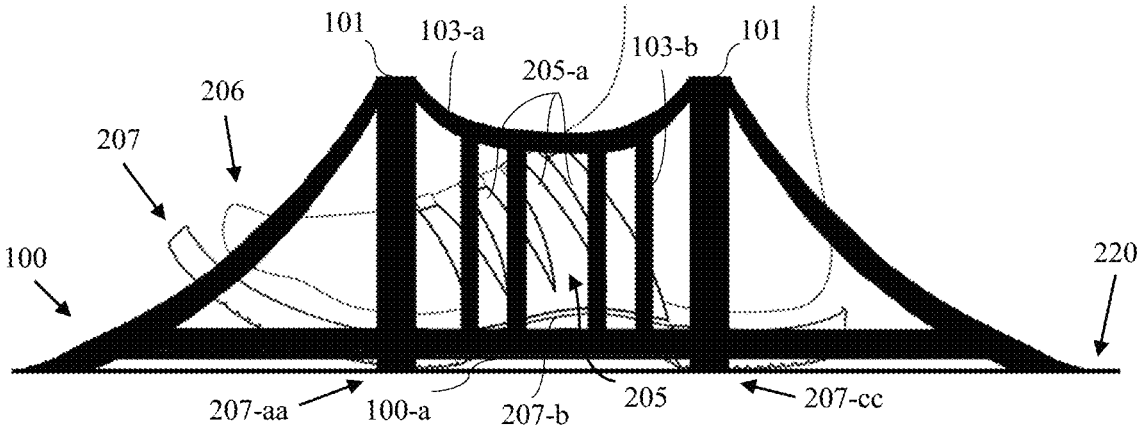
FIG. 2*b* illustrates a side view of an overlay and an outer sole of a suspension bridging shoe according to an embodiment and a suspension bridge, as shown FIG. 1, superimposed over the shoe depicting the analogous regions between the two.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 207 and 307, etc.) possess the same characteristics and are subject to the same structure and function. If there is a difference between correspondingly labeled elements that is not pointed out, and this difference results in a non-corresponding structure or function of an element for a particular embodiment, then the conflicting description given for that particular embodiment shall govern.

FIG. 1 illustrates the side view of a suspension bridge 100, as in the prior art. Suspension bridges are typically supported by towers 101, two abutments 102, main cables 103-*a* and suspender cables 103-*b* from above, which may span the length of the bridge 100 and run vertically between the two abutments 102. The force from traffic on the bridge deck 100-*a* travels up the suspender cables 103-*b* to the main cables 103-*a* and is transferred to the towers 101, which support most of the weight of the bridge deck 100-*a*. The suspender cables 103-*b* are under tension, and the tensile force 104-*a* passes to the towers 101. As the forces on the bridge deck 100-*a* are transferred to the towers 101 as compressive forces, the towers 101 are put in compression and thus support is provided to the deck 100-*a*.

FIG. 2*a* illustrates a side view of an overlay 205 and an outer sole 207 of a suspension bridging shoe, according to an embodiment. A shoe upper is not shown for clarity. Similarly to the suspension bridge 100 as shown in FIG. 1, the portion of the sole 207 between the forefoot 207-*a* and the heel 207-*c*, may be a flexible bridge 207-*b* of the outer sole 207 (hereinafter, "outer sole," "sole," or "outsole"). The flexible bridge 207-*b* may act similarly as the suspension bridge 100 bridge deck 100-*a*, and may be supported by an independent overlay 205 (hereinafter, "overlay," or "upper saddle" or "wrap overlay"). The flexible bridge 207-*b* may be lifted up off the ground along the longitudinal arches of the foot 206 from above by the overlays 205, which may have straps 205-*b*. As shown in FIG. 2*a*, the flexible bridge portion 207-*b* may be thinner (i.e., having less thickness, height-wise) relative to the forefoot portion 207-*a* and heel portion 207-*c* of the outer sole 207.

FIG. 2*b* illustrates a side view of an overlay 205 and an outer sole 207 of a suspension bridging shoe according to an embodiment and a suspension bridge 100, as shown in FIG. 1, superimposed over the shoe depicting the analogous regions between the two. The straps 205-*b* of the shoe overlay 205 may act similarly as the suspender cables 103-*b* of the suspension bridge 100, while the laces of the shoe (as shown by 212 in FIG. 2*c*) may act similarly as the main cables 103-*a* of the suspension bridge 100. The flexible bridge 207-*b* of the shoe may act similarly as the bridge deck 100-*a* of the suspension bridge 100. The forefoot portion 207-*a* and the heel portion 207-*c* of the outer sole 207 may each have a point of contact with the ground, 207-*aa* and 207-*cc*, respectively, which act similarly as the foundations of the bridge's towers 101, supporting the foot 206 by taking the force from the flexible bridge 207-*b* resulting from the runner's weight and forces required to lift the foot arch off the ground 220.

Figure 2C:
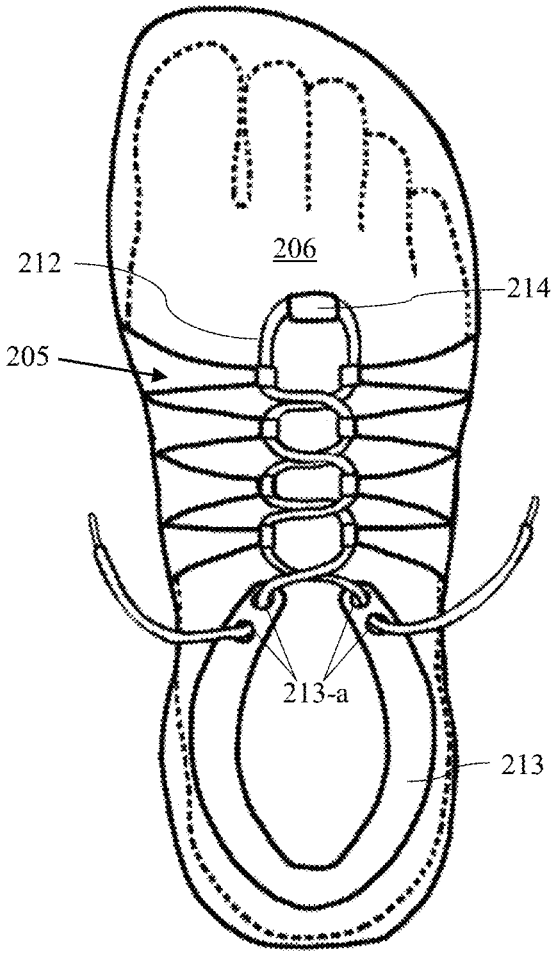
FIG. 2*c* illustrates a top view of the anchoring system of a suspension bridging shoe, according to an embodiment.

FIG. 2*c* illustrates a top view of the anchoring system of a suspension bridging shoe, according to an embodiment. Again, the laces 212 may act similarly as the main cables 103-*a* of the suspension bridge 100. The laces 212 may be anchored at the loop anchor 214 and at two pairs of eyelets 213-*a* in the collar anchor 206. The loop anchor 214 and the eyelets 213-*a* may form anchor points that may secure the shoe to the foot 206, which may be similar to the way the main cables 103-*a* are anchored to the two towers 101 of a suspension bridge 100. Additional anchoring to the foot may be provided by the grip of the overlay 205 around the foot 206.

Figure 3:
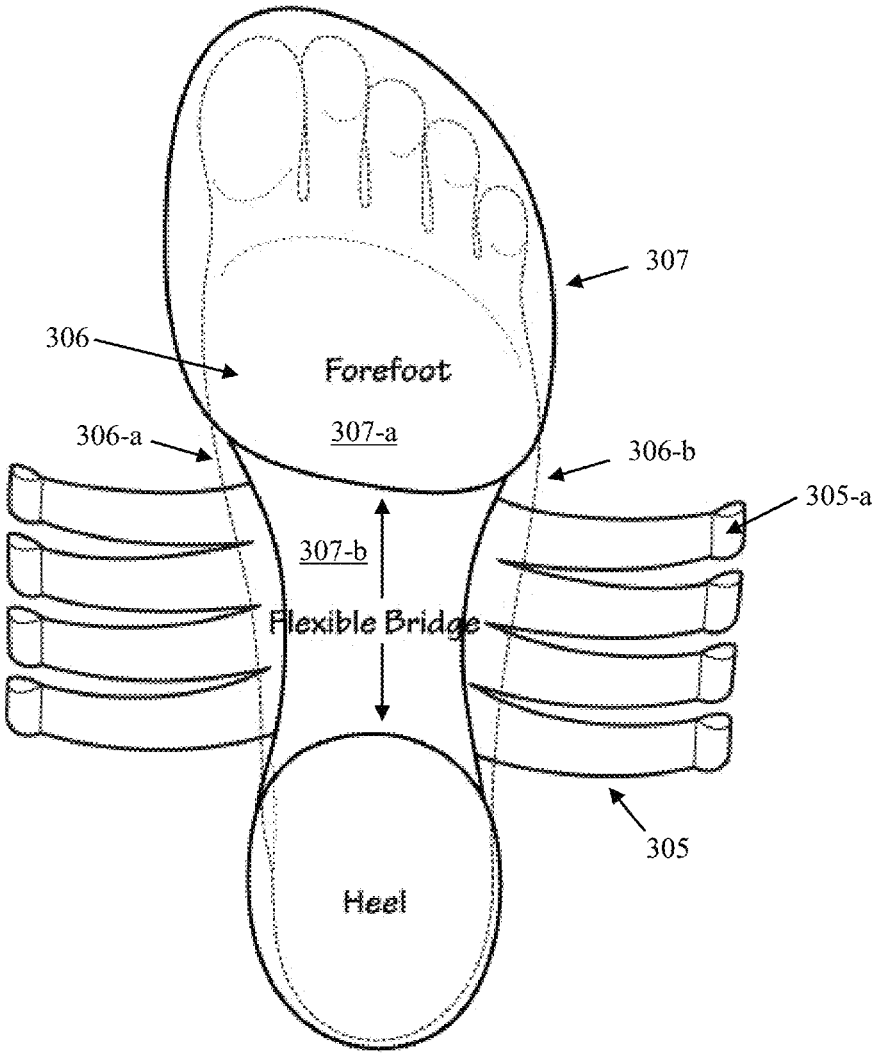
FIG. 3 illustrates a bottom view of the suspension bridging shoe of FIG. 2*a*, according to an embodiment.

FIG. 3 illustrates a bottom view of the suspension bridging shoe of FIG. 2, according to an embodiment. As an example, the overlay 305 may be attached to the outer sole 307 at the sides of the flexible bridge 307-*b*. The flexible bridge 307-*b* may lift off the ground to conform to the foot 306. In a preferred embodiment, the flexible bridge 307-*b* may be curved inwards, as shown, to be narrower than the foot 306 on both the lateral 306-*b* and medial 306-*a* sides, allowing the foot 306 to be exposed on both sides. The exposed lateral 306-*b* and medial 306-*a* sides of the foot may allow for a full 360 degrees of a "full wrap effect" arch support by the overlay 305, which may apply pressure all around both the medial and lateral arches of the foot 306. The overlay 305 may be secured with, for example, laces, threading through gillie loops 305-*a*. The forefoot region 307-*a* may include a roomy toe box which may help to mimic barefoot running.

Figure 4A:
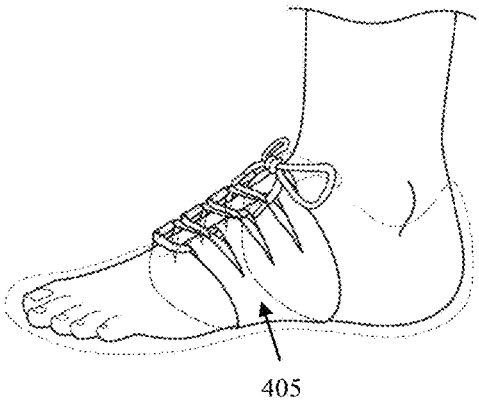
FIGS. 4*a-b* illustrate a lateral side view and a medial side view, respectively, of how the laces may connect to the overlay of the suspension bridging shoe of FIG. 2*a* worn on a foot 406.
Figure 4B:
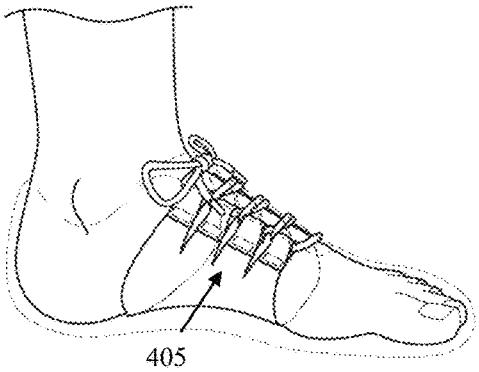
Figure 4C:
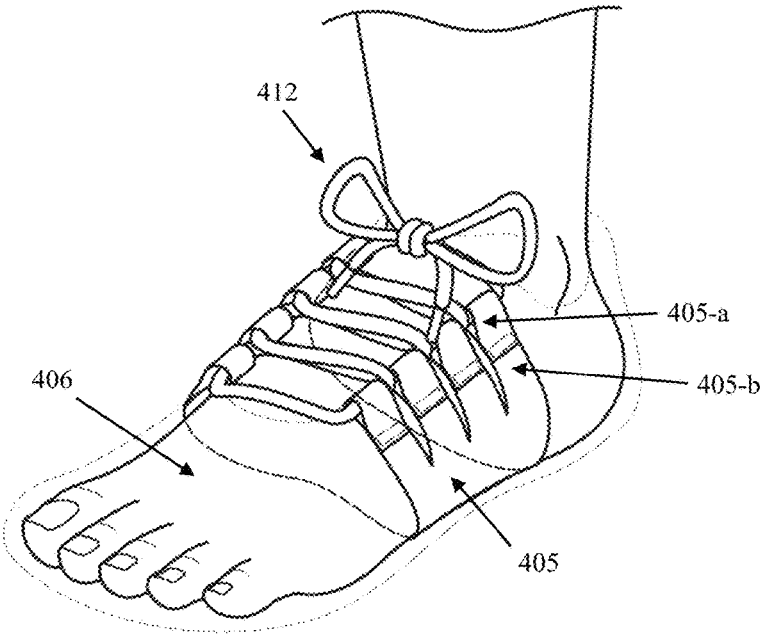
FIG. 4*c* illustrates a front-perspective view of how the laces may connect to the overlay of the suspension bridging shoe of FIG. 2*a* worn on a foot.

FIGS. 4*a*-*b* illustrate a lateral side view and a medial side view, respectively, of how the laces 412 may connect to the movable overlay 405 of the suspension bridging shoe of FIG. 2*a* worn on a foot 406. FIG. 4*c* illustrates a front-perspective view of how the laces 412 may connect to the movable overlay 405 of the suspension bridging shoe of FIG. 2*a* worn on a foot. The ends of the overlay straps 405-*b* may have gillie loops 405-*a*, through which laces 412 can be threaded. The laces 412 may serve a similar function as the main cables 103-*a* of the suspension bridge 100. The laces 412 may be tied on top of the foot 406 to secure and pull in the overlay 405 resulting in both arch support and the shoe's anchoring system, which allows for a roomy toe box to facilitate forefoot-striking running.

Figure 5:
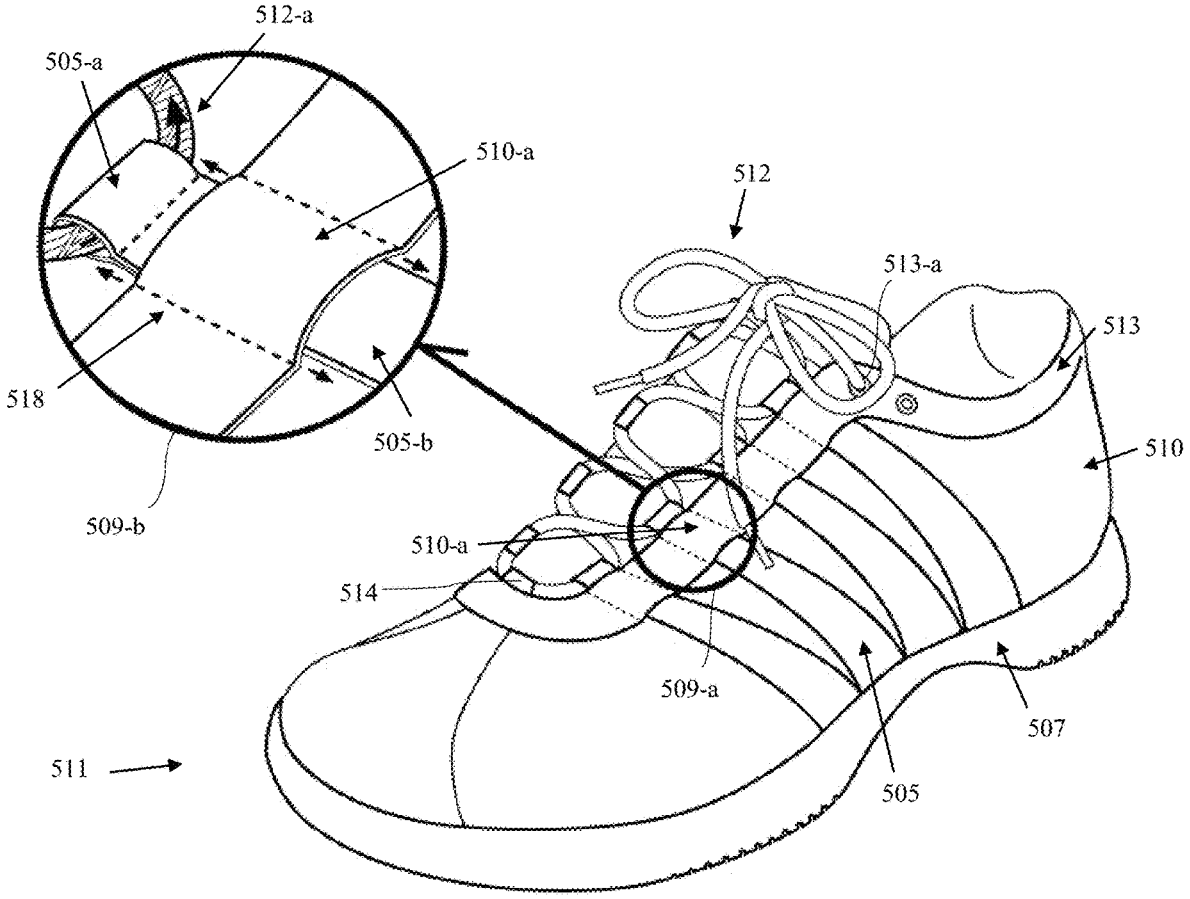
FIG. 5 illustrates a front-perspective view of a suspension bridging shoe, with a detailed enlargement of an overlay and an overlay sleeve, according to an embodiment.

FIG. 5 illustrates a front-perspective view of a suspension bridging shoe 511, with a detailed enlargement 509-*b* of an overlay 505 and an overlay sleeve 510-*a* as shown in 509-*a*, according to an embodiment. The shoe upper 510 may include sleeves 510-*a* through which the overlay 505 may thread, such that the upper 510, overlay 505, and sole 507 are held together. The overlay 505 and sole 507 may be attached by any means known in the art, such as by stitching or gluing together. The detailed enlargement 509-*b* illustrates the strap of the overlay 505-*b* inserted into the sleeve 510-*a* of the shoe upper 510. The strap 505-*b* may move through the sleeve 510-*a* as illustrated by 518, such that a snug fit may be achieved for the wearer. The shoe 511 may use laces 512 to secure the overlay 505, which may thread through a loop anchor 514 attached to the shoe upper 510. The loop anchor 514 may be independent of the overlay 505, so as to hold the laces 512 in place and to avoid the laces 512 traveling upwards on top of the foot. The laces 512 may thread through gillie loops 505-*a* of the overlay, and may be tied to secure the shoe to the foot. The laces 512 may be tied after threading through the gillie loops 505-*a*, or after threading through the gillie loops 505-*a* and also through an eyelet or pair of eyelets 513-*a* of a collar anchor 513. An advantage is that, when the laces 512 travel through both eyelets of the collar anchor 513, tension may be put along the direction of the collar 513 to help securely anchor the shoe 511. The shoe upper 510 may include the collar anchor 513 which may wrap around the wearer's ankle and may be attached completely or partially to the shoe upper 510 by any means known in the art. In another embodiment, the collar anchor 513 may be independent of the shoe upper 510.

Figure 6A:
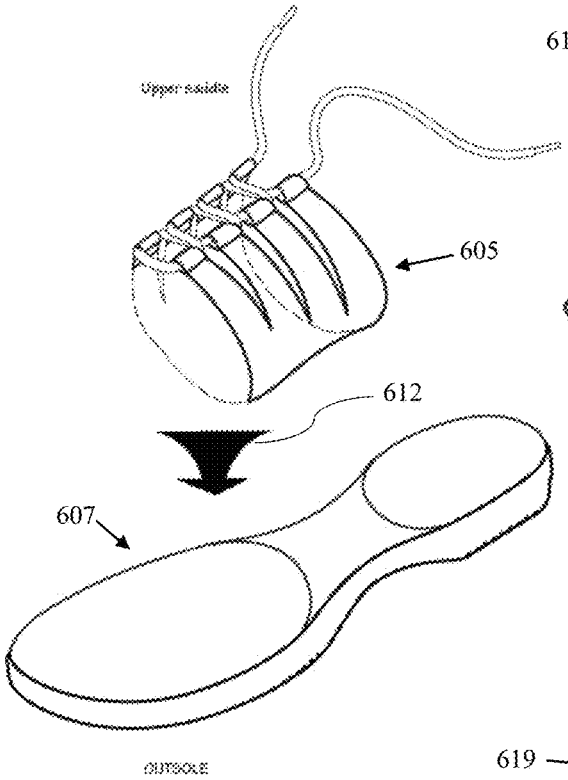
FIG. 6*a* illustrates an exploded front-perspective view of an overlay and an outer sole of the suspension bridging shoe of FIG. 2*a*.

FIG. 6*a* illustrates an exploded front-perspective view of an overlay 605 and an outer sole 607 of the suspension bridging shoe of FIG. 2, which may be combined or attached 612 into one piece by any means known in the art, such as by stitching or gluing together. For example, the overlay 605 may extend from the lateral edges of the outer sole 607. In a preferred embodiment, the overlay 605 may be associated with the outer sole 607 and wrapped around the foot from inside of the outer sole 607. In another exemplary embodiment, the outer sole 607 may be held against the foot by the overlay 605 wrapping around the foot from outside of the outer sole 607.

Figure 6B:
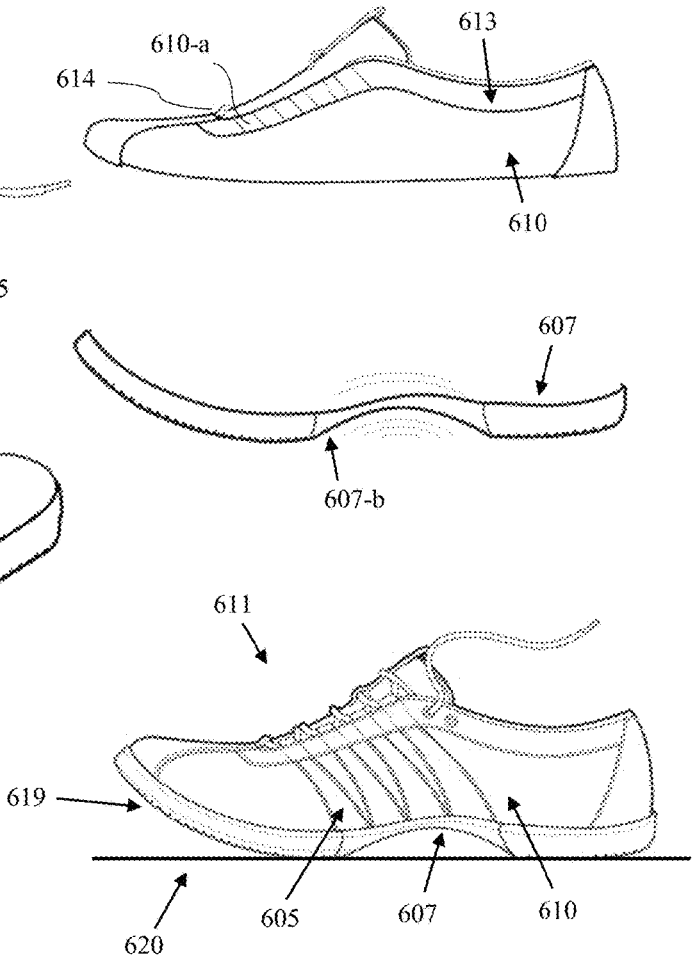
FIG. 6*b* illustrates an exploded side view of a suspension bridging shoe.

FIG. 6*b* illustrates an exploded side view of a suspension bridging shoe comprising a shoe upper 610 and a sole 607, and the shoe 611 fully assembled and laced. The shoe upper 610 may be inserted into the overlay 605, which may be attached 612 to the sole 607, and shoe is secured to the foot by the lacing system 512. The overlay 605, loop anchor 614, and collar anchor 613 may be combined into one piece by any means known in the art. The shoe 611 may have a high toe spring 619, such that the toes are lifted off of the ground 620, in order to facilitate barefoot running.

Figure 7A:
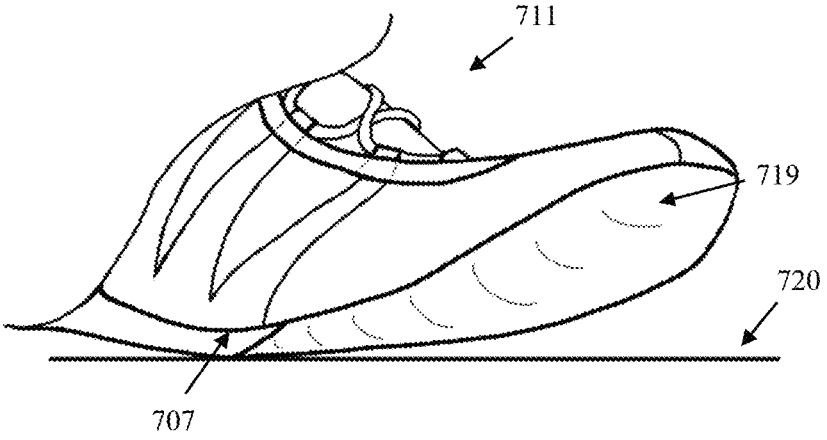
FIGS. 7*a-b* illustrate a side perspective view and front perspective view, respectively, of a suspension bridging shoe having a rounded lateral edge of the sole, according to an embodiment.
Figure 7B:
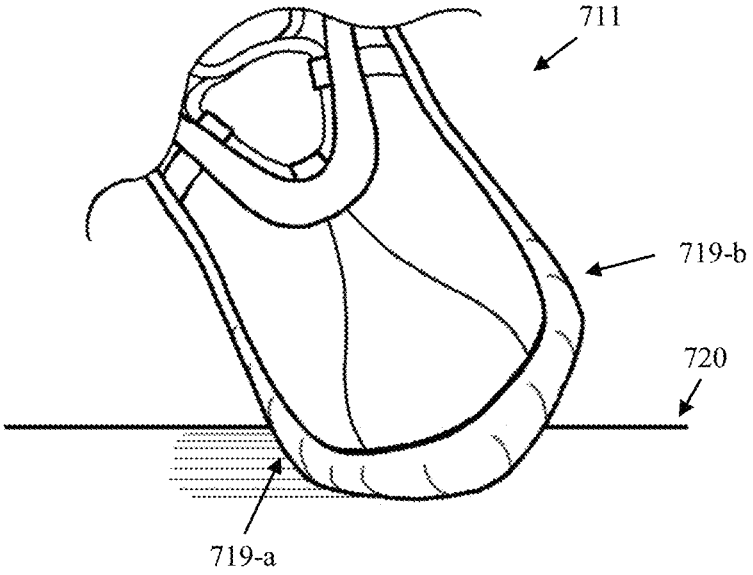

FIGS. 7*a*-*b* illustrate a side perspective view and front perspective view, respectively, of a suspension bridging shoe 711 having a rounded lateral edge 719 of the sole 707, according to an embodiment. The rounded edge 719 may allow for improved support for a forefoot-striking runner who lands with the lateral edge 719-*a* of their foot on the ground 720, as shown in FIG. 7*b*. It should be understood that a rounded edge may also be incorporated into the medial edge 719-*b*, heel, or any other area of the shoe for improved comfort or support.

It may be advantageous to set forth definitions of certain words and phrases used in this patent document. Additional definitions are set forth throughout the detailed description. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

As used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary.

Throughout this description, the embodiments and examples shown should be considered as exemplars, rather than limitations on the apparatus and procedures disclosed or claimed. Although many of the examples involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention .

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A shoe for receiving a foot, wherein the shoe is configured to simulate barefoot running by the cooperation of a set of shoe elements comprising: an outer sole configured to separate and protect the foot from a ground when the shoe receives the foot and having a forefoot portion and a heel portion, the forefoot and heel portions being configured to have a point of contact with the ground and to support the foot when the shoe receives the foot, the forefoot portion having a high toe spring that allows forefoot landing and a rounded edge that allows landing on lateral forefoot, and a flexible bridge portion extending between the forefoot portion and the heel portion, such that to form a continuous outer sole, the flexible bridge portion having a medial and a lateral side and corresponding lengthwise to the foot's lateral and medial longitudinal arches, wherein the flexible bridge portion of the outer sole is curved inwards on the medial and lateral sides and is thus narrower than the forefoot portion and the heel portion of the outer sole and also narrower than the foot on both the lateral and medial sides, thus allowing the foot's lateral and medial longitudinal arches to be both exposed to a wrap overlay, wherein the flexible bridge portion of the outer sole is flexible in all directions, such that to allow the flexible bridge portion of the outer sole to conform to the foot's lateral and medial longitudinal arches curvatures by the flexible bridge portion of the outer sole being lifted off the ground and toward the foot's lateral and medial longitudinal arches when the shoe is tied onto the foot, such that to prevent compressive force to be exercised by the ground onto the flexible bridge portion of the outer sole and thus onto the foot's lateral and medial longitudinal arches; the wrap overlay also corresponding lengthwise to the foot's lateral and medial longitudinal arches and being associated with the flexible bridge portion and having at least a first strap and at least a second strap, wherein at least the first strap is configured to be wrapped around a lateral side of the foot and at least the second strap is configured to be wrapped around a medial side of the foot, wherein at least the first and at least the second straps are configured to be tied atop a metatarsal area of the foot, to create a 360 degrees wrap formed by the flexible bridge portion of the outer sole being conformed to the foot's lateral and medial longitudinal arches curvatures and by at least the first and at least the second straps, and being suspended from atop the metatarsal area of the foot, such that to transfer tensile forces from at least the first and at least the second straps as compressive forces into the forefoot and heel portions of the outer sole, and to provide the 360 degrees wrap of the foot in a section of the foot corresponding to the foot's lateral and medial longitudinal arches resulting in both support of the foot's lateral and medial longitudinal arches and the shoe's anchoring to the foot; and, a shoe upper configured to provide toe splay and facilitate forefoot-landing by having a roomy and untied toe box corresponding to the forefoot portion of the outer sole, which is wider than the rest of the outer sole.

2. The shoe of claim 1, wherein, at least the first and at least the second straps are tied atop the metatarsal area of the foot with laces.

3. The shoe of claim 1, wherein, the wrap overlay has a bottom that is integrally formed with at least the first and at least the second straps such that the wrap overlay wraps around the section of the foot corresponding to the foot's lateral and medial longitudinal arches before being tied atop the metatarsal area of the foot.

4. The shoe of claim 1, wherein, at least the first strap and at least the second strap have each a first end and a second end, the first end being attached to the flexible bridge and the second end being attached to a gillie loop; wherein, at least two sleeves are attached to the shoe upper, through which at least the first strap and at least the second strap are slidably threaded; and wherein a lace is threaded through the gillie loops to tie up at least the first and at least the second straps atop the metatarsal area of the foot.

5. The shoe of claim 4, wherein a loop anchor is attached to the shoe upper through which the lace is threaded so as to hold the lace in place and to avoid the lace traveling upwards on top of the foot.

6. The shoe of claim 1, wherein the wrap overlay is outside of and detached from the shoe upper.

7. The shoe of claim 1 wherein the wrap overlay comprises four straps on the lateral side and four straps on the medial side of the foot.

8. The shoe of claim 2, further comprising a collar anchor around a shoe wearer's ankle, the collar anchor having at least a pair of eyelets to receive the laces so that tension is put along the collar anchor to further anchor the shoe to the foot.

9. The shoe of claim 8, wherein the collar anchor is at least partially attached to the shoe upper.

10. A shoe configured to receive a foot of a wearer and simulate barefoot running, the shoe comprising: an outer sole configured to separate and protect the foot from a ground when the shoe receives the foot and having a forefoot portion and a heel portion, the forefoot and heel portions being configured to have a point of contact with the ground and to support the foot when the shoe receives the foot, and a flexible bridge portion extending between the forefoot portion and the heel portion such that to form a continuous outer sole, wherein the flexible bridge portion of the outer sole is thinner than the forefoot portion and the heel portion, wherein the flexible bridge portion of the outer sole has a medial and a lateral side and is curved inwards on the medial and lateral sides and is thus narrower than the forefoot portion and the heel portion of the outer sole and also narrower than the foot on both the lateral and medial sides, thus allowing the foot's lateral and medial longitudinal arches to be both exposed to a wrap overlay, wherein the flexible bridge portion conforms to the foot's lateral and medial longitudinal arches curvatures specific to the foot by being lifted off the ground and toward the foot's lateral and medial longitudinal arches when the shoe is tied onto the foot; the wrap overlay being associated with the flexible bridge portion and having at least a first strap and at least a second strap, wherein at least the first strap is wrapped around a lateral side of the foot and at least the second strap is wrapped around a medial side of the foot, wherein at least the first and at least the second straps are tied atop a metatarsal area of the foot, such that to suspend the flexible bridge and thus the foot's lateral and medial longitudinal arches therefrom, and provide a 360 degrees wrap of the foot in a section of the foot corresponding to the foot's lateral and medial longitudinal arches resulting in both the foot's lateral and medial longitudinal arches support and the shoe's anchoring to the foot, and wherein, the forefoot portion and the heel portion of the outer sole are configured to touch the ground and act as the flexible bridge portion's tower foundations, taking tensile force from the flexible bridge portion to support the foot; and, a roomy and untied toe box corresponding to the forefoot portion, which is wider than the rest of the outer sole, the shoe being thus configured to provide toe splay and facilitate forefoot-striking.

11. The shoe of claim 10, wherein, the wrap overlay comprises four straps on the lateral side and four straps on the medial side of the foot.

12. The shoe of claim 10, wherein the outer sole is configured to be held against the foot by the wrap overlay wrapping around the flexible bridge portion of the outer sole and foot.

13. The shoe of claim 10, wherein the forefoot portion of the outer sole has a high toe spring that allows forefoot landing and a rounded edge that allows landing on lateral forefoot.

* * * * *